US006558068B1

(12) United States Patent
Wittig

(10) Patent No.: US 6,558,068 B1
(45) Date of Patent: May 6, 2003

(54) LIGHTED TRAFFIC CHANNELIZATION DEVICE

(76) Inventor: Dennis G. Wittig, 1640 Valley Forge Ct., Brookfield, WI (US) 53045

( * ) Notice: Subject to any disclaimer, the term of this patent is extended or adjusted under 35 U.S.C. 154(b) by 0 days.

(21) Appl. No.: 09/965,719

(22) Filed: Sep. 27, 2001

(51) Int. Cl.[7] ..... E01F 9/012
(52) U.S. Cl. ..... 404/9; 116/63 C
(58) Field of Search ..... 404/9; 116/63 C, 116/63 P

(56) References Cited

U.S. PATENT DOCUMENTS

| | | | | | |
|---|---|---|---|---|---|
| 4,292,627 | A | * | 9/1981 | Knight | 116/63 C |
| D277,739 | S | | 2/1985 | Grammas et al. | |
| 4,925,334 | A | * | 5/1990 | Beard | 116/63 C |
| 4,973,190 | A | | 11/1990 | Erwin et al. | |
| 5,036,791 | A | | 8/1991 | Thurston | |
| D320,172 | S | | 9/1991 | Thurston | |
| 5,201,599 | A | | 4/1993 | Kulp et al. | |
| 5,294,924 | A | * | 3/1994 | Dydzyk | 116/63 C |
| 5,342,140 | A | * | 8/1994 | Glass | 116/63 R |
| 5,613,798 | A | | 3/1997 | Braverman | |
| 6,116,811 | A | * | 9/2000 | Goff | 256/13.1 |
| 6,149,339 | A | * | 11/2000 | Salloum et al. | 116/63 P |
| 6,182,600 | B1 | * | 2/2001 | Brown et al. | 116/63 C |
| 6,186,699 | B1 | * | 2/2001 | Kulp et al. | 116/63 C |

FOREIGN PATENT DOCUMENTS

| | | | | |
|---|---|---|---|---|
| DE | 3940007 | * | 6/1991 | G08B/5/36 |
| EP | 303411 | * | 8/1987 | E01F/13/00 |
| EP | 564811 | * | 10/1993 | B60Q/7/00 |
| FR | 2615541 | * | 5/1987 | E01F/9/06 |
| GB | 2107446 | * | 4/1983 | E01F/9/01 |
| GB | 2197900 | * | 6/1988 | E01F/9/01 |
| GB | 2194268 | * | 3/1998 | E01F/9/01 |
| JP | 5-140916 | * | 6/1993 | E01F/13/00 |
| JP | 6-108425 | * | 4/1994 | E01F/9/00 |

* cited by examiner

*Primary Examiner*—Thomas B. Will
*Assistant Examiner*—Kristine Florio

(57) ABSTRACT

A lighted traffic channelization device for diverting traffic around hazards or construction areas in the dark. The lighted traffic channelization device includes a conically shaped barrel assembly having a base unit and a selectively couplable top section. The top section incorporates a battery-operated handle member which flashes sequentially when automatically activated by a photoelectric device when it becomes dark.

14 Claims, 4 Drawing Sheets

LIGHTED TRAFFIC CHANNELIZATION DEVICE

BACKGROUND OF THE INVENTION

1. Field of the Invention

The present invention relates to traffic controls and more particularly pertains to a new lighted traffic channelization device for diverting traffic around hazards or construction areas in the dark.

2. Description of the Prior Art

The use of traffic controls is known in the prior art. More specifically, traffic controls heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,613,798; U.S. Pat. No. 5,036,791; U.S. Pat. No. 4,973,190; U.S. Pat. No. 5,201,599; U.S. Pat. No. Des. 320,172; and U.S. Pat. No. Des. 277,739.

While these devices fulfill their respective, particular objectives and requirements, the aforementioned patents do not disclose a new lighted traffic channelization device. The inventive device includes a conically shaped barrel assembly having a base unit and a selectively couplable top section. The top section incorporates a battery-operated handle member which flashes sequentially when automatically activated by a photoelectric device when it becomes dark.

In these respects, the lighted traffic channelization device according to the present invention substantially departs from the conventional concepts and designs of the prior art, and in so doing provides an apparatus primarily developed for the purpose of diverting traffic around hazards or construction areas in the dark.

SUMMARY OF THE INVENTION

In view of the foregoing disadvantages inherent in the known types of traffic controls now present in the prior art, the present invention provides a new lighted traffic channelization device construction wherein the same can be utilized for diverting traffic around hazards or construction areas in the dark.

The general purpose of the present invention, which will be described subsequently in greater detail, is to provide a new lighted traffic channelization device apparatus and method which has many of the advantages of the traffic controls mentioned heretofore and many novel features that result in a new lighted traffic channelization device which is not anticipated, rendered obvious, suggested, or even implied by any of the prior art traffic controls, either alone or in any combination thereof.

To attain this, the present invention generally comprises a conically shaped barrel assembly having a base unit and a selectively couplable top section. The top section incorporates a battery-operated handle member which flashes sequentially when automatically activated by a photoelectric device when it becomes dark.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new lighted traffic channelization device apparatus and method which has many of the advantages of the traffic controls mentioned heretofore and many novel features that result in a new lighted traffic channelization device which is not anticipated, rendered obvious, suggested, or even implied by any of the prior art traffic controls, either alone or in any combination thereof.

It is another object of the present invention to provide a new lighted traffic channelization device which may be easily and efficiently manufactured and marketed.

It is a further object of the present invention to provide a new lighted traffic channelization device which is of a durable and reliable construction.

An even further object of the present invention is to provide a new lighted traffic channelization device which is susceptible of a low cost of manufacture with regard to both materials and labor, and which accordingly is then susceptible of low prices of sale to the consuming public, thereby making such lighted traffic channelization device economically available to the buying public.

Still yet another object of the present invention is to provide a new lighted traffic channelization device which provides in the apparatuses and methods of the prior art some of the advantages thereof, while simultaneously overcoming some of the disadvantages normally associated therewith.

Still another object of the present invention is to provide a new lighted traffic channelization device for diverting traffic around hazards or construction areas in the dark.

Yet another object of the present invention is to provide a new lighted traffic channelization device which includes a conically shaped barrel assembly having a base unit and a selectively couplable top section. The top section incorporates a battery-operated handle member which flashes sequentially when automatically activated by a photoelectric device when it becomes dark.

Still yet another object of the present invention is to provide a new lighted traffic channelization device that provides a self-contained, automatic lighted indicator of the presence of the barrel during hours of darkness.

Even still another object of the present invention is to provide a new lighted traffic channelization device that is easier to handle and take up less storage area.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in-which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
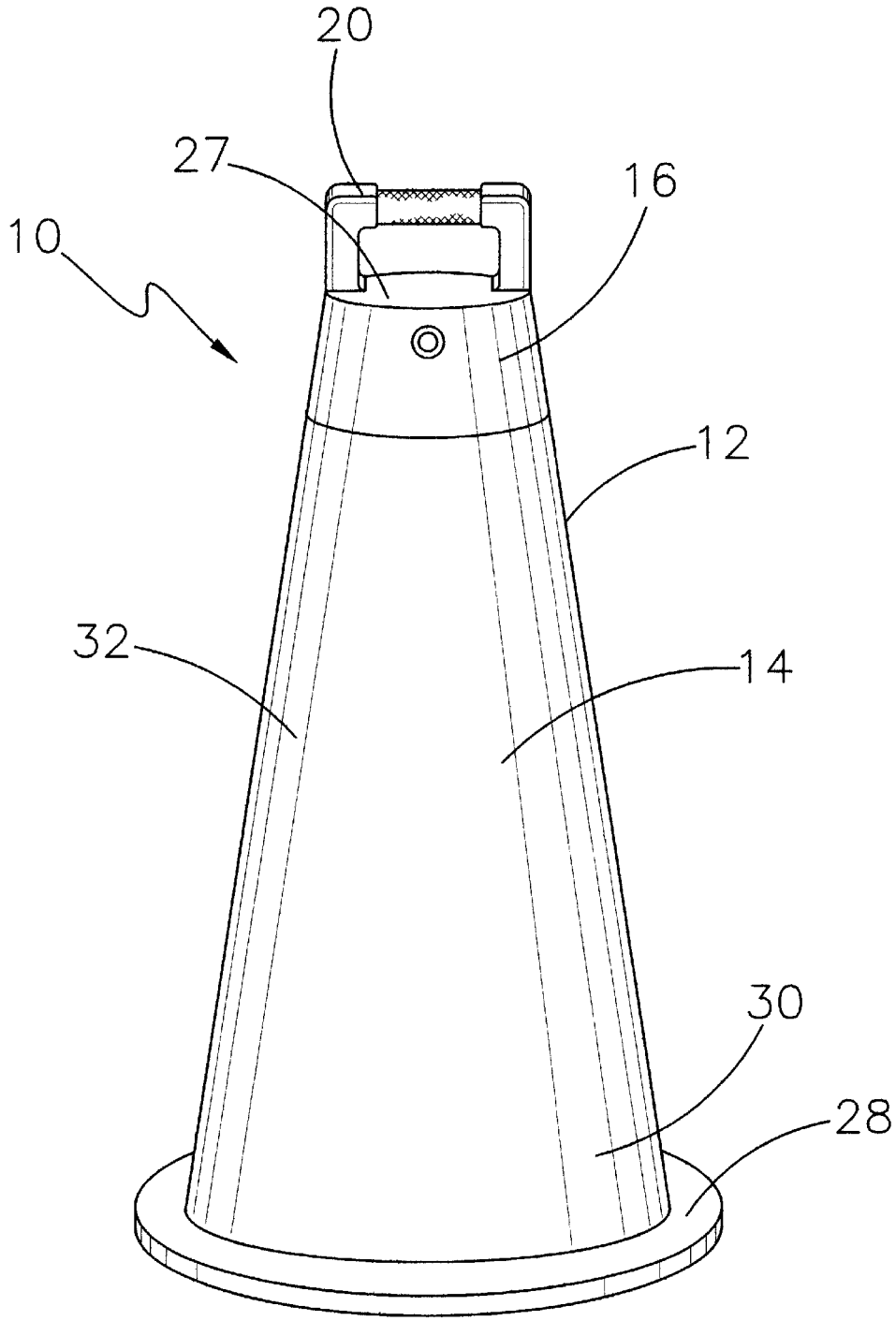
FIG. 1 is a perspective view of a new lighted traffic channelization device according to the present invention.
Figure 2:
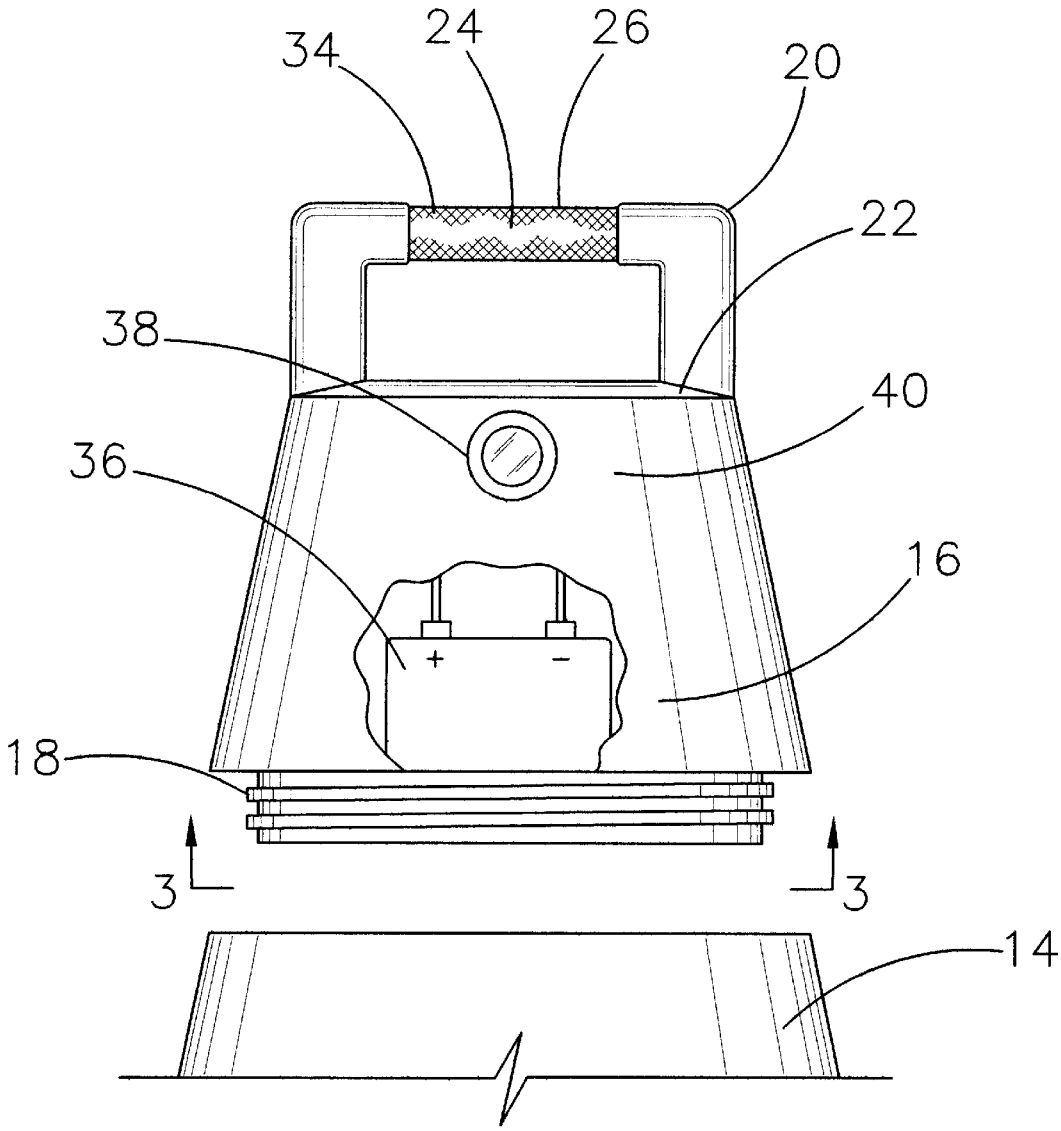
FIG. 2 is a side view of the top section of the present invention.
Figure 3:
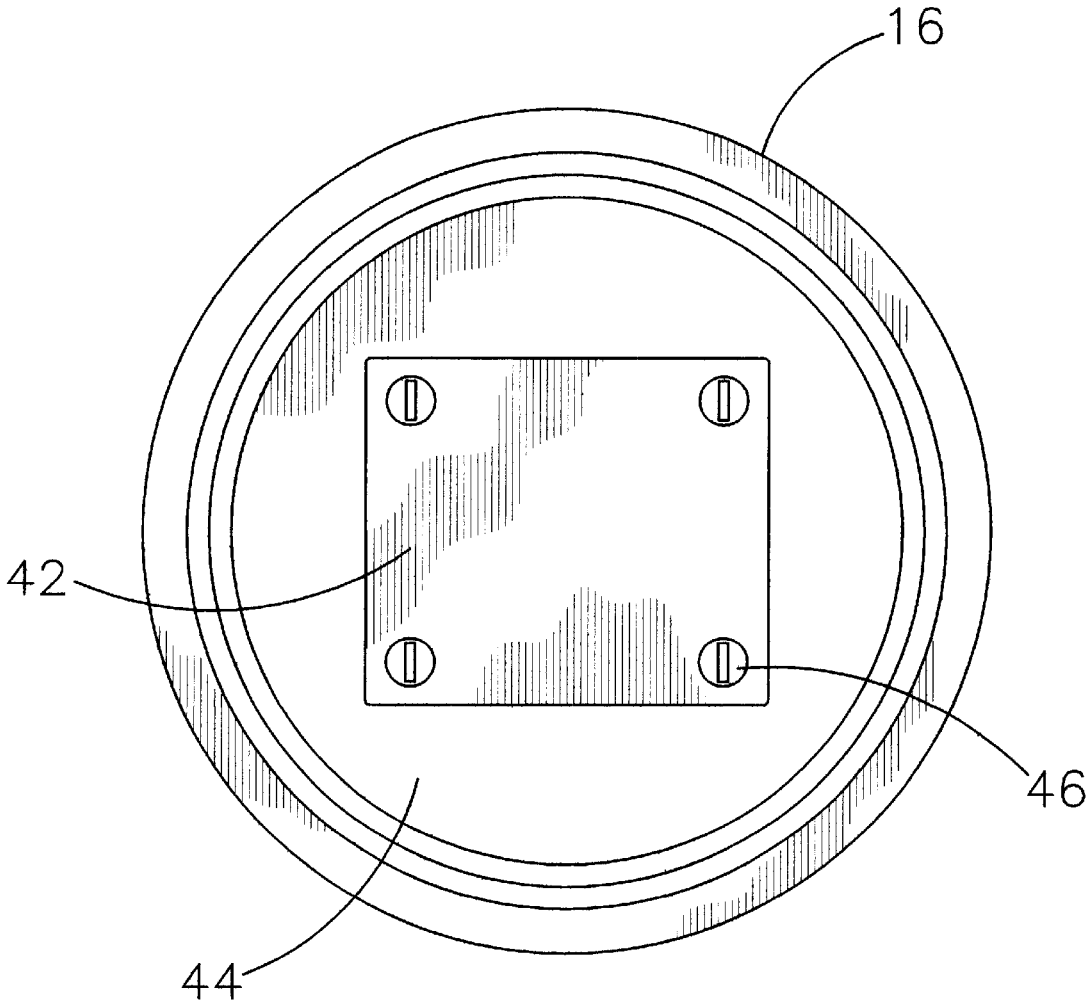
FIG. 3 is a bottom view of the top section of the present invention.
Figure 4:
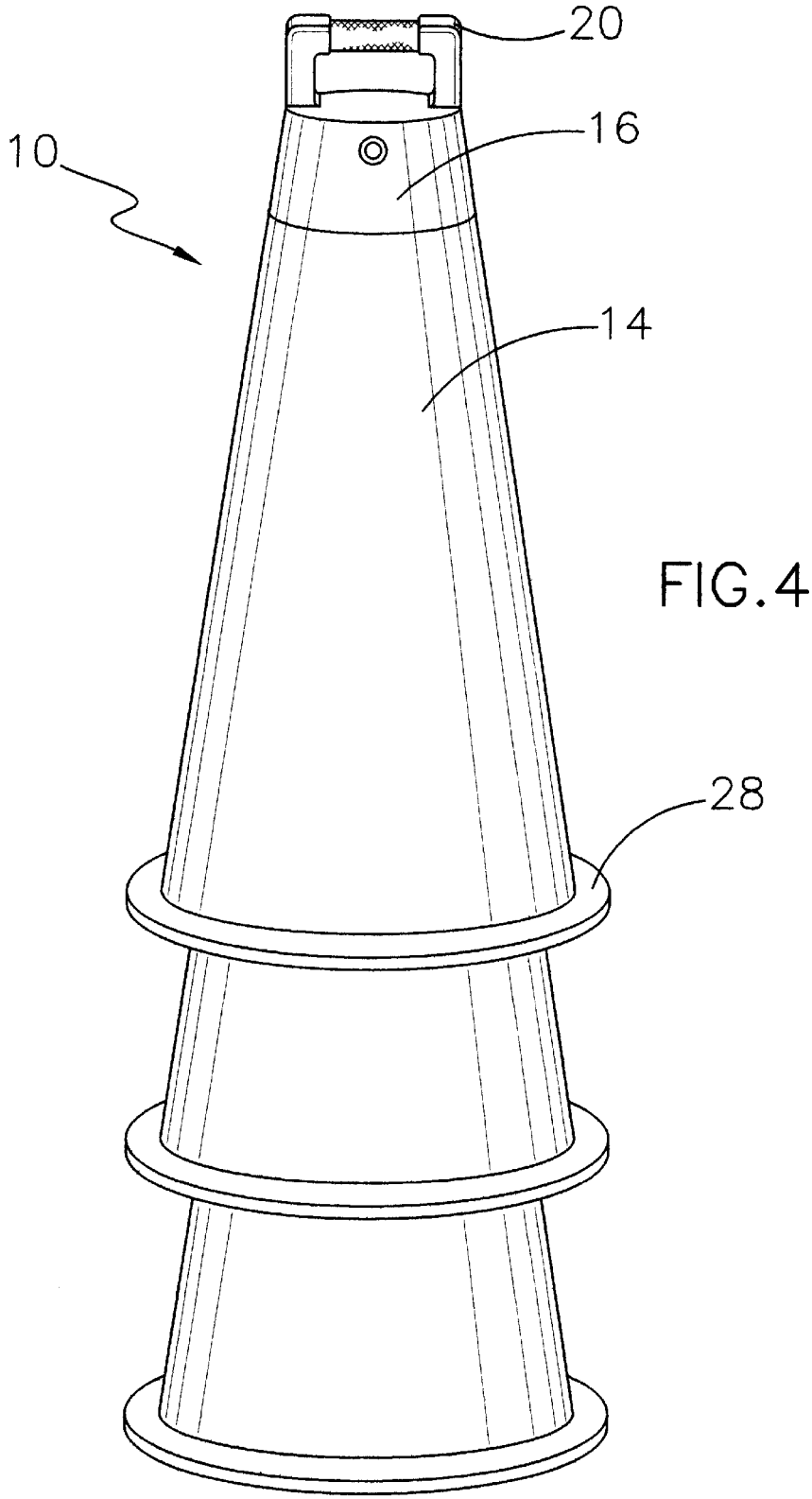
FIG. 4 is a perspective view depicting the stackability of the present invention.

With reference now to the drawings, and in particular to FIGS. 1 through 4 thereof, a new lighted traffic channelization device embodying the principles and concepts of the present invention and generally designated by the reference numeral 10 will be described.

As best illustrated in FIGS. 1 through 4, the lighted traffic channelization device 10 generally comprises a barrel assembly 12. The barrel assembly 12 includes a base unit 14. The base unit 14 has a substantially conical shaped cross-section such that the base unit 14 is designed for resting on a support surface.

The barrel assembly 12 includes a top section 16. A coupling portion 18 of the top section 16 is threadably couplable to an upper end of the base unit 14 thereby forming the barrel assembly 12.

The top section 16 includes a handle member 20. The handle member 20 is positioned on an upper surface 22 of the top section 16. The handle member 20 is designed for gripping onto by a hand of a user, thereby allowing the user to carry the barrel assembly 12 when the top section 16 and the base unit 14 are coupled.

The handle member 20 of the top section 16 includes a light source 24. The light source 24 is located in a grip portion 26 of the handle member 20. The light source 24 is designed for sequentially emitting light thereby allowing drivers to see the barrel assembly 12 in the dark.

The base unit 14 of the barrel assembly 12 has a flange portion 28. The flange portion 28 is positioned proximate a lower end 30 of the base unit 14. The flange portion 28 is designed for maintaining the base unit 14 in an upright position.

The barrel assembly 12 comprises a durable lightweight material 32 such that the barrel assembly 12 is designed for being utilized in a rugged environment.

The grip portion 26 of the handle member 20 comprises a semi-transparent material 34 such that light from the light source 24 is emitted outwardly.

The grip portion 26 is designed to conform to the hand of a user thereby allowing the user to grasp onto the barrel assembly 12.

The top section 16 of the barrel assembly 12 includes a battery 36. The battery 36 is positioned inside the top section 16. The battery 36 is designed for providing power to the light source 24.

The top section 16 of the barrel assembly 12 includes a photoelectric device 38. The photoelectric device 38 is located on a side surface 40 of the top section 16. The photoelectric device 38 is operationally coupled to the battery 36 and the light source 24 such that the photoelectric device 38 is designed for switching on the light source 24 when a lack of sunlight is present, thereby allowing the light source 24 to automatically emit light when it is dark out.

The top section 16 of the barrel assembly 12 includes a cover member 42. The cover member 42 is located on a bottom surface 44 of the top section 16. The cover member 42 has a plurality of fastening members 46. The fastening members 46 are designed for selectively coupling the cover member 42 to the bottom surface 44 of the top section 16. The cover member 42 is designed for accessing the battery 36, the photoelectric device 38, and the light source 24.

The base unit 14 of the barrel assembly 12 is substantially hollow such that the barrel assemblies are stackable.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lighted traffic channelization device for diverting traffic around hazards or construction areas especially in the dark, the lighted traffic channelization device comprising:

a barrel assembly, said barrel assembly including a base unit and a top section;

a handle member having opposite ends coupled to an upper surface of said top section whereby an opening is formed between a grip portion of said handle member and said top surface of said top section to permit insertion of a portion of a hand through said opening such that said handle member is adapted for gripping onto by a hand of a user thereby allowing the user to carry said barrel assembly; and a light source incorporated into said handle member thereby allowing drivers to see said barrel assembly in the dark.

2. The lighted traffic channelization device as set forth in claim 1, further comprising:

said base unit of said barrel assembly having a flange portion, said flange portion being positioned proximate a lower end of said base unit, said flange portion being adapted for maintaining said base unit in an upright position.

3. The lighted traffic channelization device as set forth in claim 1, further comprising:

said barrel assembly comprising a durable lightweight material such that said barrel assembly being adapted for being utilized in a rugged environment.

4. The lighted traffic channelization device as set forth in claim 1, further comprising:

said light source being positioned in said grip portion of said handle member; and said grip portion of said handle member comprising a semi-transparent material such that light from said light source being emitted outwardly.

5. The lighted traffic channelization device as set forth in claim 1, further comprising:

a battery being positioned inside said top section, said battery being operationally coupled to said light source for providing power to said light source.

6. The lighted traffic channelization device as set forth in claim 5, further comprising:

a photoelectric device being located on said top section, said photoelectric-device being operationally coupled to said battery and said light source such that said photoelectric device is adapted for switching on said light source when a lack of ambient light is present thereby allowing said light source to automatically emit light upon said photoelectric device detecting a low light condition.

7. The lighted traffic channelization device as set forth in claim 6, further comprising:

said top section being removable from said base unit;

said top section of said barrel assembly including a cover member, said cover member being located on a bottom surface of said top section, said cover member having a plurality of fastening members, said fastening members being adapted for selectively coupling said cover member to said bottom surface of said top section, said cover member being adapted for accessing said battery, said photoelectric device, and said light source.

8. The lighted traffic channelization device as set forth in claim 1, further comprising:

said base unit of said barrel assembly being substantially hollow such that said barrel assemblies are stackable.

9. A lighted traffic channelization device for diverting traffic around hazards or construction areas especially in the dark, the lighted traffic channelization device comprising:

barrel assembly, said barrel assembly including a base unit and a top section;

a handle member having opposite ends coupled to an upper surface of said top section whereby an opening is formed between a grip portion of said handle member and said top surface of said top section to permit insertion of a portion of a hand through said opening such that said handle member is adapted for gripping onto by a hand of a user thereby allowing the user to carry said barrel assembly;

a light source incorporated into said handle member thereby allowing drivers to see said barrel assembly in the dark;

said base unit of said barrel assembly having a flange portion, said flange portion being positioned proximate a lower end of said base unit, said flange portion being adapted for maintaining said base unit in an upright position;

said barrel assembly comprising a durable lightweight material such that said barrel assembly being adapted for being utilized in a rugged environment;

said light source being positioned in said grip portion of said handle member;

said grip portion of said handle member comprising a semitransparent material such that light from said light source being emitted outwardly;

a battery being positioned inside said top section, said battery being operationally coupled to said light source for providing power to said light source;

a photoelectric device being located on said top section, said photoelectric device being operationally coupled to said battery and said light source such that said photoelectric device is adapted for switching on said light source when a lack of ambient light is present thereby allowing said light source to automatically emit light upon said photoelectric device detecting a low light condition;

said top section being removable from said base unit;

said top section of said barrel assembly including a cover member, said cover member being located on a bottom surface of said top section, said cover member having a plurality of fastening members, said fastening members being adapted for selectively coupling said cover member to said bottom surface of said top section, said cover member being adapted for accessing said battery, said photoelectric device, and said light source; and said base unit of said barrel assembly being substantially hollow such that said barrel assemblies are stackable.

10. The lighted traffic channelization device as set forth in claim 9, further comprising:

said top section being removable from said base unit; and said top section being threadably couplable to said base unit.

11. The lighted traffic channelization device as set forth in claim 9, wherein said light source is in said grip portion of said handle member.

12. The lighted traffic channelization device as set forth in claim 9 wherein said handle member is substantially inverted U-shaped.

13. The lighted traffic channelization device as set forth in claim 9 wherein said light source sequentially emits light for promoting visibility of said light source.

14. The lighted traffic channelization device as set forth in claim 9 wherein said base unit is substantially conical.

* * * * *